US010760584B2

(12) United States Patent
Fukuyama et al.

(10) Patent No.: US 10,760,584 B2
(45) Date of Patent: Sep. 1, 2020

(54) SPEED INCREASER AND CENTRIFUGAL COMPRESSOR

(71) Applicant: KABUSHIKI KAISHA TOYOTA JIDOSHOKKI, Aichi-ken (JP)

(72) Inventors: Ryosuke Fukuyama, Aichi-ken (JP); Kaho Takeuchi, Aichi-ken (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 363 days.

(21) Appl. No.: 15/469,956

(22) Filed: Mar. 27, 2017

(65) Prior Publication Data

US 2017/0276144 A1 Sep. 28, 2017

(30) Foreign Application Priority Data

Mar. 28, 2016 (JP) ..... 2016-064204
Mar. 7, 2017 (JP) ..... 2017-043217

(51) Int. Cl.

| | |
|---|---|
| ***F04D 17/10*** | (2006.01) |
| ***F04D 29/054*** | (2006.01) |
| ***F04D 25/06*** | (2006.01) |
| ***F04D 29/28*** | (2006.01) |

(52) U.S. Cl.

CPC ..... *F04D 29/054* (2013.01); *F04D 17/10* (2013.01); *F04D 25/06* (2013.01); *F04D 29/284* (2013.01)

(58) Field of Classification Search

CPC ..... F04D 29/054; F04D 17/10; F04D 25/06; F04D 29/284; F04D 25/028

See application file for complete search history.

(56) References Cited

U.S. PATENT DOCUMENTS 1,106,246 A * 8/1914 Schoedelin ..... F16H 13/06 476/67
2,778,227 A * 1/1957 Roesch ..... G01C 19/38 74/5.7
2,815,685 A * 12/1957 Parrett ..... F16H 13/06 475/183
2,828,938 A * 4/1958 Roesch ..... F01D 25/16 310/83
3,380,312 A * 4/1968 Barske ..... F16H 13/02 476/61

(Continued)

FOREIGN PATENT DOCUMENTS

| | | |
|---|---|---|
| JP | 2002-31202 | 1/2002 |
| JP | 2003-314446 | 11/2003 |
| JP | 2005-188709 | 7/2005 |

*Primary Examiner* — Aaron R Eastman
*Assistant Examiner* — Theodore C Ribadeneyra
(74) *Attorney, Agent, or Firm* — Greenblum & Bernstein, P.L.C.

(57) ABSTRACT

A speed increaser includes a high-speed shaft, an annular peripheral wall surrounding the high-speed shaft and rotatable with a rotation of a low-speed shaft, the peripheral wall having an inner peripheral surface and a projection extending inwardly from the inner peripheral surface in a radial direction of the high-speed shaft, and a roller disposed between the high-speed shaft and the peripheral wall and having an outer peripheral surface that is in contact with both the projection and an outer peripheral surface of the high-speed shaft. A centrifugal compressor includes the speed increaser, an electric motor driving to rotate the low-speed shaft, and an impeller mounted to the high-speed shaft.

7 Claims, 4 Drawing Sheets

(56) References Cited

U.S. PATENT DOCUMENTS 3,776,051 A * 12/1973 Kraus ..... F16H 13/14 476/61
3,848,476 A * 11/1974 Kraus ..... F16H 13/04 476/67
3,941,004 A * 3/1976 Kraus ..... F16H 13/04 476/8
3,945,270 A * 3/1976 Nelson ..... F16H 13/04 476/61
4,224,840 A * 9/1980 Kraus ..... F16H 13/04 476/61
4,249,784 A * 2/1981 Ichikawa ..... F16C 19/50 384/494
4,371,218 A * 2/1983 Ichikawa ..... D01H 4/12 310/90.5
4,408,503 A * 10/1983 Kraus ..... F16H 13/04 476/65
4,440,043 A * 4/1984 Kraus ..... F16H 13/06 475/159
4,471,667 A * 9/1984 Kraus ..... F16H 13/08 476/61
4,481,842 A * 11/1984 Nelson ..... F16H 13/06 476/61
4,491,038 A * 1/1985 Kraus ..... F16H 13/06 475/183
4,555,963 A * 12/1985 Nelson ..... F16H 13/06 475/195
4,648,288 A * 3/1987 Kato ..... F16H 13/10 475/183
4,649,307 A * 3/1987 Bech ..... H02K 49/00 310/83
4,709,589 A * 12/1987 Kraus ..... F16H 13/06 411/369
5,037,361 A * 8/1991 Takahashi ..... F16H 13/06 475/183
5,085,091 A * 2/1992 Stampa ..... F16H 13/06 384/552
5,443,054 A * 8/1995 Tateno ..... F02B 39/04 123/559.1
5,688,201 A * 11/1997 Zhou ..... F16H 13/06 475/183
5,720,661 A * 2/1998 Yoshizawa ..... F24F 7/06 454/341
5,931,759 A * 8/1999 Otaki ..... B62M 6/40 475/183
6,162,145 A * 12/2000 Wang ..... F16H 13/06 476/67
6,482,121 B2 11/2002 Okoshi
6,554,730 B1 * 4/2003 Sakai ..... B62M 6/55 180/206.4
6,719,658 B2 * 4/2004 Haga ..... F16H 1/2836 475/163
6,789,438 B2 * 9/2004 Tanaka ..... F02N 15/067 476/67
6,796,126 B2 * 9/2004 Hasegawa ..... F01D 5/026 123/559.1
6,960,147 B2 * 11/2005 Kolstrup ..... F16H 13/06 475/170
7,153,230 B2 * 12/2006 Ai ..... F16H 13/06 475/166
8,152,677 B2 * 4/2012 Knepper ..... F16H 13/06 475/183
8,382,630 B2 * 2/2013 Brinks ..... F16H 13/08 475/185
8,668,614 B2 * 3/2014 Sherrill ..... F16H 13/10 475/183
9,670,832 B2 * 6/2017 Sherrill ..... F02B 37/105
10,107,183 B2 * 10/2018 Sherrill ..... F02B 37/105
2005/0074341 A1 * 4/2005 Dairokuno ..... F04D 13/021 417/410.1
2013/0220285 A1 * 8/2013 Hayashi ..... F02B 37/10 123/565
2015/0260194 A1 * 9/2015 Kagami ..... F04D 25/045 415/122.1
2017/0234316 A1 * 8/2017 Suelter ..... F04D 25/028 415/104
2017/0284518 A1 * 10/2017 Fukuyama ..... F04D 17/10
2017/0298957 A1 * 10/2017 Howe ..... F04D 25/028
2017/0365866 A1 * 12/2017 Waldron ..... H01M 8/04111
2018/0347675 A1 * 12/2018 Kawahara ..... F16H 13/04

* cited by examiner

SPEED INCREASER AND CENTRIFUGAL COMPRESSOR

BACKGROUND OF THE INVENTION

The present invention relates to a speed increaser and a centrifugal compressor equipped with the speed increaser.

A speed increaser that transmits the rotation of a low-speed shaft to a high-speed shaft has been known in the art pertaining to the present invention. Japanese Patent Application Publication 2003-314446 discloses a speed increaser including a peripheral wall that is rotatable with the rotation of a low-speed shaft, a high-speed shaft that is disposed within the peripheral wall, and a roller that is disposed between the peripheral wall and the high-speed shaft and has an outer peripheral surface that is in contact with the inner peripheral surface of the peripheral wall and the outer peripheral surface of the high-speed shaft. The roller and the high-speed shaft are held by tightening of the peripheral wall.

According to the speed increaser of the above-cited publication, an oil film (elastohydrodynamic lubrication film) is formed at a contact area between the peripheral wall and the roller and at a contact area between the roller and the high-speed shaft with the rotation of the peripheral wall, and the rotation is transmitted through the oil film.

In order for the oil film to be formed stably during the rotation, pressure to some extent need be applied to the contact area between the inner peripheral surface of the peripheral wall and the outer peripheral surface of the roller and also to the contact area between the outer peripheral surface of the roller and the outer peripheral surface of the high-speed shaft.

Since the high-speed shaft and the roller are in contact with each other at their outer peripheral surfaces, the area surface of the contact area tends to become small. On the other hand, the peripheral wall and the roller are in contact with each other at the inner peripheral surface of the peripheral wall and the outer peripheral surface of the roller, so that the contact area between the peripheral wall and the roller is greater than that of the contact area between the high-speed shaft and the roller. Consequently, the pressure at the contact area between the peripheral wall and the roller tends to become small.

In this case, if a tightening of the peripheral wall is increased so as to increase the pressure at the contact area between the peripheral wall and the roller, there is a fear that power loss between the high-speed shaft and the roller may be increased and the high-speed shaft may be subjected to an increased load.

The present invention, which has been made in light of the above problems, is directed to providing a speed increaser that successfully transmits power from the peripheral wall to the high-speed shaft and a centrifugal compressor equipped with such speed increaser.

SUMMARY OF THE INVENTION

In accordance with an aspect of the present invention, there is provided a speed increaser including a high-speed shaft, an annular peripheral wall surrounding the high-speed shaft and rotatable with a rotation of a low-speed shaft, the peripheral wall having an inner peripheral surface and a projection extending inwardly from the inner peripheral surface in a radial direction of the high-speed shaft, and a roller disposed between the high-speed shaft and the peripheral wall and having an outer peripheral surface that is in contact with both the projection and an outer peripheral surface of the high-speed shaft.

In accordance with another aspect of the present invention, there is provided a centrifugal compressor including a low-speed shaft, an electric motor driving to rotate the low-speed shaft, a speed increaser including a high-speed shaft, an annular peripheral wall surrounding the high-speed shaft and rotatable with a rotation of the low-speed shaft, the peripheral wall having an inner peripheral surface and a projection extending inwardly from the inner peripheral surface in a radial direction of the high-speed shaft. The centrifugal compressor further includes a roller disposed between the high-speed shaft and the peripheral wall and having an outer peripheral surface that is in contact with both the projection and an outer peripheral surface of the high-speed shaft, and an impeller mounted to the high-speed shaft.

Other aspects and advantages of the invention will become apparent from the following description, taken in conjunction with the accompanying drawings, illustrating by way of example the principles of the invention.

DETAILED DESCRIPTION OF THE EMBODIMENTS

The following will describe a speed increaser and a centrifugal compressor equipped with such speed increaser according to a first embodiment of the present invention. The centrifugal compressor of the present embodiment is mounted on a fuel cell vehicle (FCV) having a fuel cell battery and sends air to the fuel cell battery.

Figure 1:
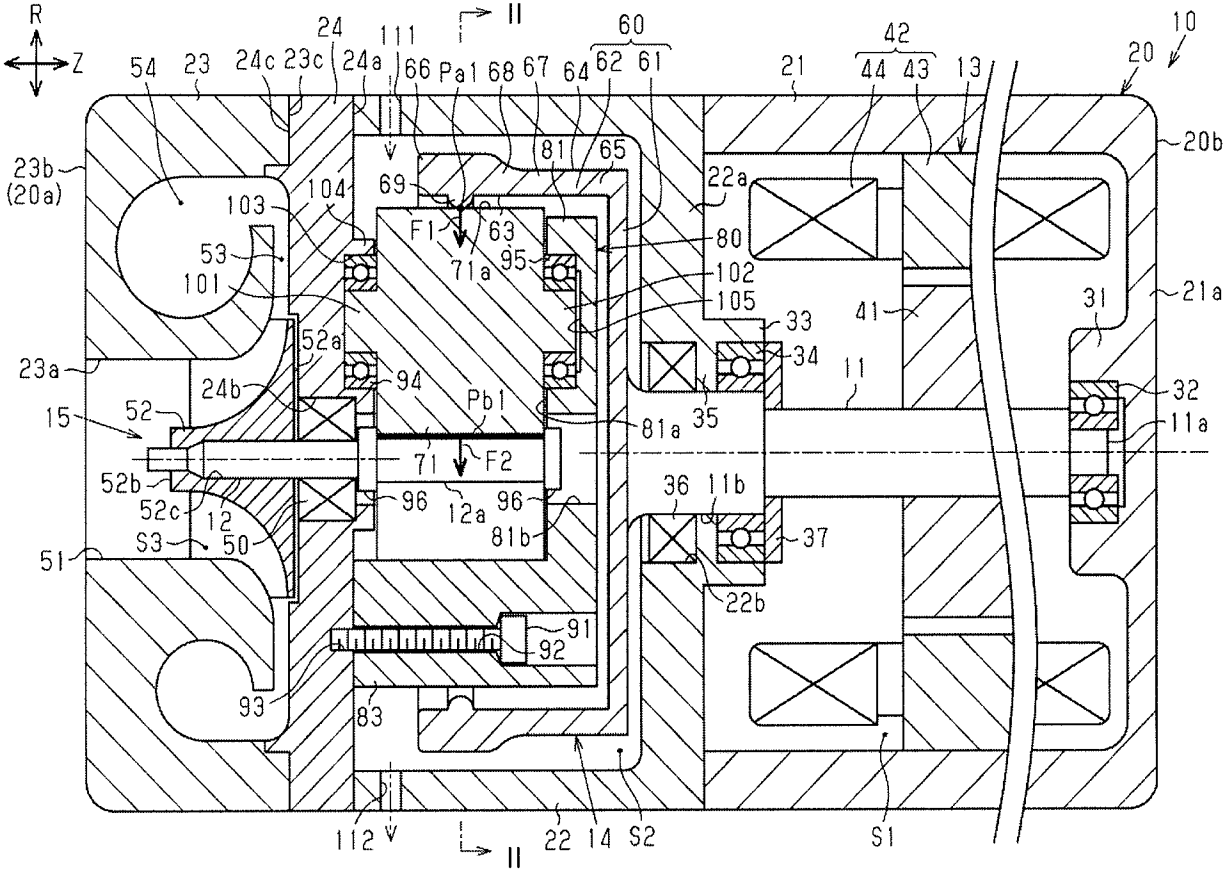
FIG. 1 is a schematic longitudinal sectional view of a speed increaser and a centrifugal compressor according to an embodiment of the present invention.

Referring to FIG. 1, there is shown a centrifugal compressor 10 that includes a low-speed shaft 11, a high-speed shaft 12, an electric motor 13 driving to rotate the low-speed shaft 11, a speed increaser 14 increasing the rotation speed of the low-speed shaft 11 and transmitting it to the high-speed shaft 12 and a compression part 15 compressing a fluid (air in the present embodiment) with the rotation of the high-speed shaft 12. For the sake of the illustration, the low-speed and high-speed shafts 11, 12 are shown in side view in FIG. 1. The low-speed and high-speed shafts 11, 12 are made of a metal such as a steel or a steel alloy.

The centrifugal compressor 10 includes a housing 20 that forms the outer shell of the centrifugal compressor 10. The housing 20 accommodates therein the low-speed and high-speed shafts 11, 12, the electric motor 13, the speed increaser 14 and the compression part 15. The housing 20 has a generally cylindrical shape and has end surfaces 20*a*, 20*b* at the axial ends of the housing 20, respectively.

The housing 20 includes a motor housing 21 accommodating therein the electric motor 13, a speed increaser housing 22 accommodating therein the speed increaser 14 and a compressor housing 23 having a intake port 23*a* through which a fluid is drawn in. The intake port 23*a* is formed in the end of the compressor housing 23 at the end surface 20*a*. The compressor housing 23, the speed increaser housing 22 and the motor housing 21 are arranged in this order in axial direction of the housing 20 as seen from the intake port 23*a*. The housing 20 further includes a plate 24 that is interposed between the speed increaser housing 22 and the compressor housing 23.

The centrifugal compressor 10 of the present embodiment is mounted in a horizontal position on the vehicle in a manner so that the axial direction of the housing 20 corresponds to the horizontal direction of the vehicle. Additionally, the vertical direction shown in FIG. 1 corresponds to the vertical direction of the vehicle.

The motor housing 21 has a generally bottomed cylindrical shape and includes bottom portion 21*a*. The outer surface of the bottom portion 21*a* of the motor housing 21 forms end surface 20*b* of the housing 20 that is located opposite end from the end surface 20*a* having the intake port 23*a*. The speed increaser housing 22 also has a generally cylindrical shape and includes a bottom portion 22*a*.

The motor housing 21 and the speed increaser housing 22 are connected together with the opened end of the motor housing 21 disposed in abutment with the bottom portion 22*a* of the speed increaser housing 22. The inner surface of the motor housing 21 and the surface of the bottom portion 22*a* of the speed increaser housing 22 facing the motor housing 21 cooperate to form a motor chamber S1 in which the electric motor 13 is disposed. The low-speed shaft 11 is accommodated in the motor chamber S1 in a manner so that the rotation axis of the low-speed shaft 11 extends in the axial direction of the housing 20.

The low-speed shaft 11 is rotatably supported by the housing 20. A cylindrical first boss 31 is formed extending from the bottom portion 21*a* of the motor housing 21 towards the speed increaser housing 22. The first boss 31 has a diameter that is greater than the diameter of one end 11*a* of the low-speed shaft 11 that is disposed adjacent to the end surface 20*b* of the housing 20. The one end 11*a* of the low-speed shaft 11 is inserted in the first boss 31, and a first bearing 32 is mounted in the first boss 31 and rotatably supports the low-speed shaft 11 at the one end 11*a* thereof.

A hole 22*b* having a diameter greater than the other end 11*b* of the low-speed shaft 11 is formed through the bottom portion 22*a* of the speed increaser housing 22. The bottom portion 22*a* has a cylindrical second boss 33 extending from the outer periphery of the hole 22*b* toward the motor housing 21, or the first boss 31. The other end 11*b* of the low-speed shaft 11 is inserted through the second boss 33, and a second bearing 34, which support the low-speed shaft 11 rotatably, is disposed between the inner surface of the second boss 33 and the other end 11*b* of the low-speed shaft 11. The second boss 33 of the bottom portion 22*a* has a projected portion 35 extending radially inwardly at a boundary between the inner peripheral surface of the hole 22*b* and the inner peripheral surface of the second boss 33. The second bearing 34 is disposed in the space formed by the second boss 33 and the projected portion 35.

As shown in FIG. 1, the other end 11*b* of the low-speed shaft 11 is inserted through the hole 22*b* of the speed increaser housing 22, so that part of the low-speed shaft 11 is positioned in the speed increaser housing 22. A seal member 36 is interposed between the inner peripheral surface of the hole 22*b* of the speed increaser housing 22 and the other end 11*b* of the low-speed shaft 11 so as to prevent oil from flowing out from the speed increaser housing 22 into the motor chamber S1. The seal member 36 is disposed on side of the projected potion 35 that is opposite from the second bearing 34 and in the area between the inner peripheral surface of the hole 22*b* of the speed increaser housing 22 and the other end 11*b* of the low-speed shaft 11.

As shown in FIG. 1, a positioning member 37 is fixed on the low-speed shaft 11 so as to position the low-speed shaft 11 relative to the housing 20. The positioning member 37 is disposed on the side of the second bearing 34 that is adjacent to the electric motor 13. The positioning member 37 has a disk shape extending radially outwardly from the outer peripheral surface of the low-speed shaft 11. The positioning member 37 is set in contact with the second bearing 34. Such contact of the second bearing 34 with the positioning member 37 prevents dislocation of the low-speed shaft 11 in the axial direction thereof which may occur when the low-speed shaft 11 is subjected to an axial force directing from the one end 11*a* toward the other end 11*b*.

The electric motor 13 includes a rotor 41 that is fixed on the low-speed shaft 11 and a stator 42 that is disposed radially outward of the rotor 41 and fixed to the inner peripheral surface of the motor housing 21. The rotor 41 and the stator 42 are disposed coaxially with the low-speed shaft 11. The rotor 41 and the stator 42 face each other in the radial direction of the low-speed shaft 11.

The stator 42 includes a cylindrical stator core 43 and a coil 44 wounded around the stator core 43. With the coil 44 energized by electric current, the rotor 41 and the low-speed shaft 11 are rotated integrally.

The plate 24 of the housing 20 has a disk shape with a diameter that is substantially the same as that of the speed increaser housing 22. The plate 24 is connected at the first surface 24*a* thereof to the opened end of the bottomed cylindrical speed increaser housing 22. A speed increaser chamber S2 is formed by the first surface 24*a* of the plate 24 and the inner surface of the speed increaser housing 22.

The plate 24 has a hole 24*b* through which the high-speed shaft 12 forming a part of the speed increaser 14 is inserted. Part of the high-speed shaft 12 extends out from the hole 24*b* and is positioned in the compressor housing 23. It is noted that the high-speed shaft 12 forms a part of the speed increaser.

A seal member 50 is interposed between the inner peripheral surface of the hole 24*b* and the high-speed shaft 12 so as to seal therebetween, thereby preventing oil from flowing out from the speed increaser housing 22 into the compressor housing 23.

The compressor housing 23 has a generally cylindrical shape and has a hole 51 is formed extending axially through the compressor housing 23. The end surface 23*b* of the compressor housing 23 forms the end surface 20*a* of the housing 20. The end of the hole 51 disposed adjacently to the end surface 23*b* serves as the intake port 23*a*.

The compressor housing 23 and the plate 24 are assembled together with the end surface 23*c* of the compressor housing 23 that is opposite to the end surface 23*b* and the second surface 24*c* of the plate 24 that is opposite to the first surface 24*a* set in contact with each other. With the compressor housing 23 and the plate 24 thus assembled, an impeller chamber S3 is formed by the inner peripheral surface of the hole 51 and the second surface 24*c*. The impeller chamber S3 accommodates therein an impeller 52. In other words, the hole 51 serves as the intake port 23*a* and also forms part of the impeller chamber S3. The intake port 23*a* and the impeller chamber S3 are in communication with each other.

The diameter of the hole 51 is constant from the end thereof adjacent to the end surface 23*b* of the compressor housing 23 to an axially intermediate position of the hole 51 and increases gradually from the axially intermediate position towards the end of the hole 51 adjacently to the second surface 24*c* of the plate 24. In other words, the hole 51 has a shape that is similar to a truncated circular cone shape from the axially intermediate position to the end that is adjacent to the second surface 24*c* of the plate 24. Thus, the impeller chamber S3 has a generally truncated circular cone shape.

The impeller 52 is also of a shape that is similar to a truncated cone and has a base end surface 52*a* and a front end surface 52*b*. The diameter of the impeller 52 is reduced from the base end surface 52*a* towards the front end surface 52*b*. The impeller 52 has therethrough an insertion hole 52*c* formed extending in the axial direction thereof through which the high-speed shaft 12 is inserted. The impeller 52 is mounted on the high-speed shaft 12 for rotation therewith with part of the high-speed shaft 12 projecting out into the hole 51 inserted through the insertion hole 52*c*. With the rotation of the high-speed shaft 12, the impeller 52 rotates thereby to compress fluid drawn in through the intake port 23*a*.

The centrifugal compressor 10 has a diffuser passage 53 through which the fluid compressed by the impeller 52 is flowed and a discharge chamber 54 into which the fluid passed through the diffuser passage 53 is discharged. The diffuser passage 53 is formed by the second surface 24*c* of the plate 24 and the surface of the compressor housing 23 that is formed continuously with the inner end of the hole 51 and faces the second surface 24*c* of the plate 24. The diffuser passage 53 has an annular shape and is disposed radially outward of the impeller chamber S3 so as to surround the impeller 52 and the impeller chamber S3. The impeller chamber S3 and the discharge chamber 54 are in communication with each other through the diffuser passage 53. The fluid compressed by impeller 52 is further compressed while passing through the diffuser passage 53 toward the discharge chamber 54 and discharged from the discharge chamber 54.

The following will describe the speed increaser 14 according to a first embodiment. The speed increaser 14 of the present embodiment is of a so-called traction drive type (friction roller type). As shown in FIG. 1, the speed increaser 14 includes a ring member 60 that is connected to the other end 11*b* of the low-speed shaft 11. The ring member 60 is made of a metal.

The ring member 60 includes a base 61 that has a disk shape and is connected to the other end 11*b* of the low-speed shaft 11 and a peripheral wall 62 that extends from the outer periphery of the base 61 toward the plate 24. The base 61 and the peripheral wall 62 are rotatable with the rotation of the low-speed shaft 11.

The peripheral wall 62 has a ring shape. The peripheral wall 62 has an inner peripheral surface 63 and the outer peripheral surface 64. The peripheral wall 62 has a base end portion 65 that is disposed adjacently to the base 61 and a distal end portion 66 that is disposed opposite from the base 61.

According to the present embodiment, the peripheral wall 62 has an inner diameter that is substantially constant at any position in the axial direction Z. The inner diameter of the peripheral wall 62 is greater than the diameter of the other end 11*b* of the low-speed shaft 11. For the sake of the description, part of the peripheral wall 62 having the wall thickness that is substantially the same as the base end portion 65 will be referred to as a body portion 67 and part of the peripheral wall 62 connecting between the body portion 67 and the distal end portion 66 will be referred to as a connecting portion 68.

According to the present embodiment, the ring member 60 and the low-speed shaft 11 are connected so that the rotation axis of the base 61 of the ring member 60 and the rotation axis of the low-speed shaft 11 coincide with each other. In this case, the rotation axis of the peripheral wall 62 is disposed coaxially with the rotation axis of the low-speed shaft 11. The inner diameter and the outer diameter of the peripheral wall 62 are concentric with respect to the rotation axis of the low-speed shaft 11.

Since the ring member 60 is connected to the low-speed shaft 11, the positioning member 37 that positions the low-speed shaft 11 relative to the housing 20 may serve as a positioning member of the ring member 60. In other words, the positioning member 37 positions the ring member 60 in its axial position relative to the housing 20.

Figure 2A:
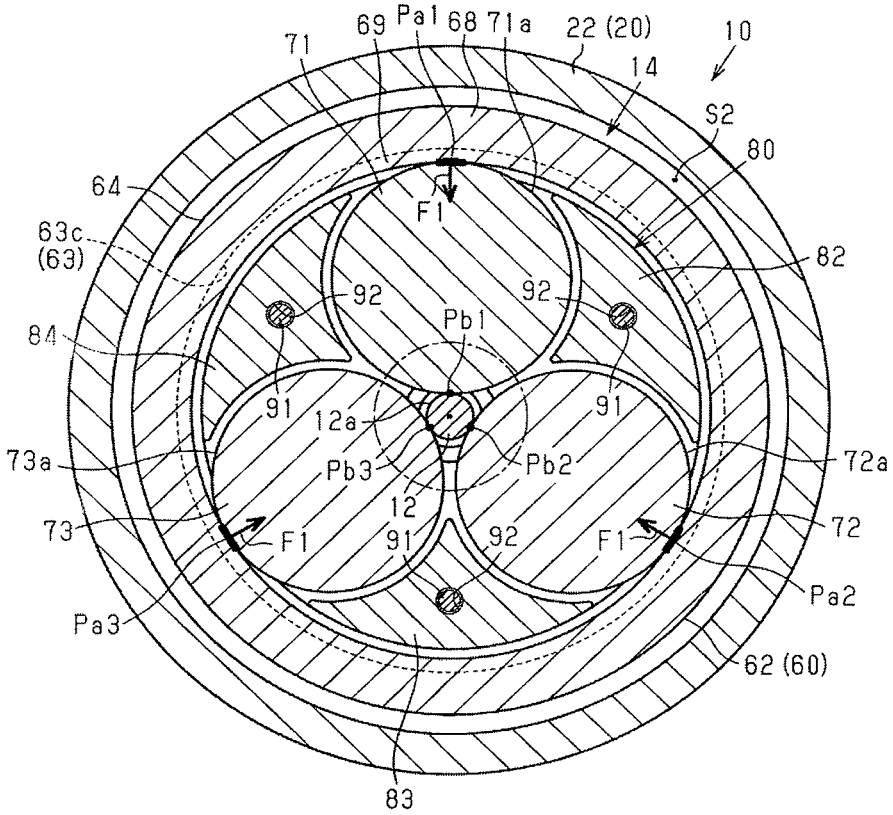
FIG. 2A is a cross-sectional view taken along line II-II of FIG. 1.
Figure 2B:
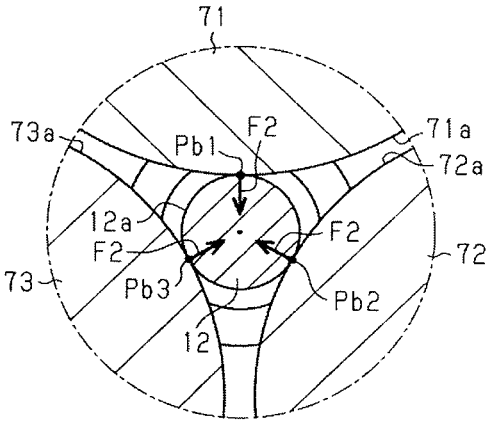
FIG. 2B is a partially enlarged view of the FIG. 2A.

The speed increaser 14 includes the high-speed shaft 12, and part of the high-speed shaft 12 is disposed within the peripheral wall 62. In other words, the peripheral wall 62 surrounds the high-speed shaft 12. As shown in FIGS. 2A and 2B, the speed increaser 14 includes a plurality of rollers, namely the first roller 71, the second roller 72, the third roller 73, disposed between the high-speed shaft 12 and the peripheral wall 62. Specifically, the rollers 71, 72, 73 are in contact with both a projection 69 of the peripheral wall 62, which will be described later, and an outer peripheral surface 12*a* of the high-speed shaft 12. The rollers 71, 72, 73 have a cylindrical shape. The rotation axes of the rollers 71, 72, 73 extend parallel to each other in the axial direction Z of the high-speed shaft 12. For the sake of description, the projection 69 is illustrated in enlarged size in FIG. 1 through 3.

The rollers 71, 72, 73 are spaced angularly at a regular interval (120 degree in the present embodiment) in the circumferential direction of the high-speed shaft 12. The rollers 71, 72, 73 are made of a metal. Specifically, the rollers 71, 72, 73 are made of the same metal material as the high-speed shaft 12 and the ring member 60 (peripheral wall 62). Oil is supplied to the high-speed shaft 12, the peripheral wall 62 and the rollers 71, 72, 73.

As shown in FIGS. 1 and 2, the speed increaser 14 includes a support member 80 that supports the rollers 71, 72, 73 rotatably in cooperation with the plate 24. The support member 80 is disposed radially inward of the peripheral wall 62 of the ring member 60. The support member 80 includes a disk-shaped support base 81 having a diameter smaller than the inner diameter of the peripheral wall 62 and three columnar support portions 82, 83, 84 extending axially from the support base 81 toward the plate 24. The support base 81 is disposed facing on one side thereof the base 61 of the ring member 60 and other side thereof the plate 24. The support portions 82, 83, 84 extend from a surface 81*a* of the support base 81 that faces the first surface 24*a* and are disposed in the spaces each of which defined by the inner peripheral surface 63 of the peripheral wall 62 and the outer peripheral surfaces of any two adjacent rollers 71, 72, 73.

As shown in FIG. 2A, the first support portion 82 is disposed in a space formed by the inner peripheral surface 63 of the peripheral wall 62, the outer peripheral surface 71*a* of the first roller 71 and the outer peripheral surface 72*a* of the second roller 72 with a uniform clearance formed therebetween, respectively.

The second support portion 83 is disposed in a space formed by the inner peripheral surface 63 of the peripheral wall 62, the outer peripheral surface 72*a* of the second roller 72 and the outer peripheral surface 73*a* of the third roller 73 with a uniform clearance formed therebetween, respectively.

The third support portion 84 is disposed in a space formed by the inner peripheral surface 63 of the peripheral wall 62, the outer peripheral surface 71*a* of the first roller 71 and the outer peripheral surface 73*a* of the third roller 73 with a uniform clearances formed therebetween, respectively.

As shown in FIGS. 1 and 2A, a threaded hole 92 is formed for each of the support portions 82, 83, 84 for engagement with a bolt 91 serving as a fastener. A threaded hole 93 is formed in the plate 24 for each threaded hole 92. The threaded holes 93 are formed in the plate 24 in alignment with the threaded holes 92 in the support portions 82, 83, 84, respectively, and the end surfaces of the support portions 82, 83, 84 disposed adjacently to the first surface 24*a* of the plate 24, the bolts 91 engaged both the threaded holes 92 of the support portions 82, 83, 84 and their corresponding threaded holes 93 of the plate 24, so that the support portions 82, 83, 84 are fixed to the plate 24, respectively.

The first, second and third rollers 71, 72, 73 are disposed between the plate 24 and the support base 81 of the support member 80 and rotatably supported by a first roller bearing 94 fixed to the plate 24 and a second roller bearing 95 fixed to the support base 81, respectively.

Specifically, as shown in FIG. 1, the first roller 71 has first and second projections 101, 102 having a cylindrical shape and extending in the axial direction Z from the center of the opposite end surfaces of the first roller 71, respectively.

The plate 24 has a recess 103 that is recessed in the first surface 24*a* of the plate 24. The recess 103 has a diameter greater than that of the first projection 101 and smaller than that of the first roller 71. The plate 24 has a cylindrical portion 104 projects from the outer periphery of the plate recess 103. The cylindrical portion 104 has an inner diameter substantially the same as the diameter of the plate recess 103. The first projection 101 is disposed in a space formed by the cylindrical portion 104 and the plate recess 103. The first roller bearing 94 is disposed between the first projection 101 and the inner peripheral surface formed by the cylindrical portion 104 and the plate recess 103. The first roller bearing 94 is fixed to the plate 24 while supporting the first projection 101 rotatably.

The support base 81 has a recess 105 on the side adjacent to the first roller 71 that is recessed in the surface 81*a* of the base 81. The recess 105 has a diameter greater than that of the second projection 102 and smaller than that of the first roller 71. The second projection 102 is disposed in the recess 105. The second roller bearing 95 is disposed between the second projection 102 and the peripheral surface of the recess 105 and fixed to the support member 80 while supporting the second projection 102 rotatably.

The second and third rollers 72, 73 are rotatably supported in the same manner as the first roller 71. As shown in FIG. 2A, the diameters of the rollers 71, 72, 73 are greater than the diameter of the high-speed shaft 12. The diameters of the respective rollers 71, 72, 73 are smaller than the inner radius of the peripheral wall 62 so as to be disposed inside the peripheral wall 62.

It is to be noted that the diameter of the first roller 71 is different from that of the second and third rollers 72, 73, as shown in FIG. 2A. More specifically, the first roller 71 is formed with a diameter that is greater than that of the second and third rollers 72, 73. Therefore, the high-speed shaft 12 which is pressedly supported by the rollers 71, 72, 73 is positioned eccentrically with respect to the axis of the peripheral wall 62. In other words, the rotation axis of the high-speed shaft 12 and the rotation axis of the peripheral wall 62 are not aligned.

As shown in FIG. 1, the high-speed shaft 12 has a pair of flanges 96 extending radially outwardly from the outer peripheral surface 12*a* thereof. The flanges 96 are spaced apart in the axial direction Z of the high-speed shaft 12. The first, second and third rollers 71, 72, 73 are disposed between the paired flanges 96 in the axial direction Z. This prevents the dislocation of the first, second and third rollers 71, 72, 73 and the high-speed shaft 12 in the axial direction Z. Specifically, for example, the first roller 71 whose end surface on the side adjacent to the impeller 52 is set in contact with its associated flange 96 is prevented from being moved by any thrust force created in the axial direction caused by the rotation of the impeller 52.

The spaced distance between the paired flanges 96 in the axial direction Z is slightly greater than the axial dimension of the first, second and third rollers 71, 72, 73. Accordingly, clearances into which oil may be entered are formed between the flanges 96 and the end surfaces of the first, second and third rollers 71, 72, 73, respectively.

The base 81 of the support member 80 has at the center thereof a hole S1*b* having a diameter that is greater than the flange 96 so that the flange 96 located adjacently to the base 61 is disposed in the hole 81*b*. The other flange 96 positioned adjacently to the impeller 52 is disposed in the hole 24*b* of the plate 24.

Figure 3:
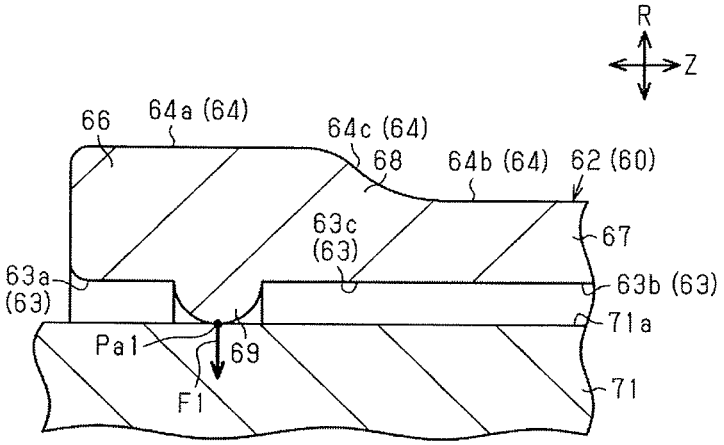
FIG. 3 is a fragmentary enlarged schematic cross-sectional view showing a first ring contact area according to a first embodiment.

The following will describe the peripheral wall 62 of the ring member 60 in detail with reference to FIGS. 1 through 3. For the sake of illustration, FIG. 3 only shows contact of the first roller 71 with the peripheral wall 62. It is noted that the second and third rollers 72, 73 are set in contact with the peripheral wall 62 substantially in the same manner. Unless otherwise indicated, the following description will be made assuming that the shaft 11, 12 and the rollers 71, 72, 73 are at a stop.

As shown in FIGS. 1 to 3, the peripheral wall 62 of the ring member 60 has the projection 69 that is formed extending inwardly in the radial direction R of the high-speed shaft 12 from the inner peripheral surface 63 of the peripheral wall 62. As shown in FIG. 2A, the projection 69 has an annular shape extending in circumferential direction of the peripheral wall 62. As shown in FIGS. 1 and 3, the projection 69 has a semicircular shape as seen in longitudinal section of the speed increaser 14, or the projection 69 is taken in a plane perpendicular to the circumferential direction of the peripheral wall 62. The projection 69 of the peripheral wall 62 is in contact with the outer peripheral surfaces 71*a*, 72*a*, 73*a* of the respective first, second and third rollers 71, 72, 73.

With the projection 69 of the peripheral wall 62 in contact with the outer peripheral surfaces 71*a*, 72*a*, 73*a* of the first, second and third rollers 71, 72, 73, the inner peripheral surface 63 of the peripheral wall 62 is spaced apart from the outer peripheral surfaces 71*a*, 72*a*, 73*a* of the first, second and third rollers 71, 72, 73.

As shown in FIG. 3, the distal end portion 66 of the peripheral wall 62 has a wall thickness that is greater than that of the body portion 67. The wall thickness of the distal end portion 66 and the wall thickness of the body portion 67 are substantially constant at any position in the axial direction Z, respectively.

The connecting portion 68 of the peripheral wall 62 connecting the distal end portion 66 and the body portion 67 has a wall thickness that is varied along the axial direction Z. Specifically, the wall thickness of the connecting portion 68 is increased toward the distal end portion 66. The connecting portion 68 also has a wall thickness that is greater than that of the body portion 67. The distal end portion 66 and the connecting portion 68 correspond to the thick wall portion and the body portion 67 and the base end portion 65 corresponds to the thin wall portion, respectively, of the present invention. The thick wall portion has a wall thickness that is greater than the thin wall portion.

The outer peripheral surface 64 of the peripheral wall 62 is formed stepped corresponding to the varied wall thickness of the peripheral wall 62 along the axial direction Z. Meanwhile, the inner peripheral surface 63 of the peripheral wall 62 has no stepped portion.

As shown in FIG. 3, the inner peripheral surface 63 of the peripheral wall 62 includes a first inner surface 63*a* corresponding to the distal end portion 66. The first inner surface 63*a* of the inner peripheral surface 63 faces an axially intermediate part of the outer peripheral surfaces 71*a*, 72*a*, 73*a* of the respective first, second and third rollers 71, 72, 73 with respect to the axial direction of the high-speed shaft 12. The inner peripheral surface 63 of the peripheral wall 62 further includes a second inner surface 63*b* and a third inner surface 63*c* corresponding to the body portion 67 and the connecting portion 68, respectively. The first, second and third inner surfaces 63*a*, 63*b*, 63*c* are formed in the same circle. The first and third inner surfaces 63*a*, 63*c* correspond to the above-mentioned part of the inner peripheral surface corresponding to the thick wall portion according to the present invention.

The outer peripheral surface 64 of the peripheral wall 62 includes a first outer surface 64*a* corresponding to the distal end portion 66, a second outer surface 64*b* corresponding to the body portion 67 and a third outer surface 64*c* corresponding to the connecting portion 68. The second outer surface 64*b* extends along the axial direction Z of the high-speed shaft 12. In other words, the second outer surface 64*b* and the axial direction Z extend substantially in parallel. The distance from the axis of the high-speed shaft 12 to the second outer surface 64*b* is substantially constant.

The first outer surface 64*a* is a circumferential surface that is disposed outward of the second outer surface 64*b* in the radial direction R of the high-speed shaft 12. The first outer surface 64*a* extends along the axial direction Z of the high-speed shaft 12. The distance from the axis of the high-speed shaft 12 to the first outer surface 64*a* is constant at any position along the axial direction Z.

The third outer surface 64*c* is a surface connecting the first outer surface 64*a* and the second outer surface 64*b*. The distance from the high-speed shaft 12 to the third outer surface 64*c* is increased towards the distal end portion 66. In other words, the third outer surface 64*c* is tapered towards the base end portion 65.

In the peripheral wall 62 having such configuration, the projection 69 is formed in the distal end portion 66 having a wall thickness greater than the body portion 67. In other words, the projection is formed extending from the inner peripheral wall corresponding to the thick wall portion. Specifically, the projection 69 is formed extending from the first inner surface 63*a* that faces the axially intermediate part of the outer peripheral surfaces 71*a*, 72*a*, 73*a* of the respective rollers 71, 72, 73 in the radial direction R of the high-speed shaft 12.

According to present embodiment, the projection 69 is in contact with the axially intermediate part of the outer peripheral surfaces 71*a*, 72*a*, 73*a* of the respective first, second and third rollers 71, 72, 73. It is noted, however, that the projection 69 may be set in contact with any suitable part of the outer peripheral surfaces 71*a*, 72*a*, 73*a* of the first, second and third rollers 71, 72, 73.

As shown in FIG. 1, parts of the rollers 71, 72, 73 project out from the peripheral wall 62 toward the plate 24. In other words, part of the outer peripheral surfaces 71*a*, 72*a*, 73*a* of the first, second and third rollers 71, 72, 73 are exposed without facing the inner peripheral surface 63 of the peripheral wall 62 in radial direction R of the high-speed shaft 12. It is noted, however, that the rollers 71, 72, 73 may be disposed so that the entire outer peripheral surfaces 71*a*, 72*a*, 73*a* of the first, second and third rollers 71, 72, 73 face the inner peripheral surface 63 of the peripheral wall 62.

As shown in FIG. 2B, the rollers 71, 72, 73, the ring member 60 and the high-speed shaft 12 are assembled into a unit in such a way that and the high-speed shaft 12 is rotatably supported by the rollers 71, 72, 73. These parts are fastened into a unit by the tightening of the peripheral wall 62. The projection 69 is set in contact with the outer peripheral surfaces 71*a*, 72*a*, 73*a* of the respective rollers 71, 72, 73 at first, second and third ring contact areas Pa1, Pa 2, Pa3, respectively. Pressure F1 is applied from the projection 69 to each of the rollers 71, 72, 73 at the ring contact areas Pa1, Pa 2, Pa3 by the tightening of the peripheral wall 62. As shown in FIG. 2B, the outer peripheral surfaces 71*a*, 72*a*, 73*a* of the first, second and third rollers 71, 72, 73 are set in contact with the outer peripheral surface 12*a* of the high-speed shaft 12 at first, second and third shaft contact areas Pb1, Pb2, Pb3. Pressure F2 is applied to the high-speed shaft 12 at the shaft contact areas Pb1, Pb2, Pb3.

As shown in FIG. 2A, the dimension of the ring contact areas Pa1, Pa2, Pa3 in the circumferential direction of the high-speed shaft 12 is greater than that of the shaft contact areas Pb1, Pb2, Pb3. As shown in FIG. 1, the shaft contact areas Pb1, Pb2, Pb3 extend in axial direction Z. On the other hand, the dimension of the ring contact areas Pa1, Pa 2, Pa3 in the axial direction Z is smaller than that of the shaft contact areas Pb1, Pb2, Pb3 because of the formation of the projection 69.

The ring contact areas Pa1, Pa2, Pa3 may be formed greater or smaller than the shaft contact areas Pb1, Pb2, Pb3 as long as the ring contact areas Pa1, Pa2, Pa3 are relatively similar to those of the shaft contact areas Pb1, Pb2, Pb3, as compared with the case in which the inner peripheral wall of the ring member is formed with a constant radius of curvature in the axial direction. The surface areas of the ring contact areas Pa1, Pa2, Pa3 may have the surface area that is substantially the same as the shaft contact areas Pb1, Pb2, Pb3.

When the peripheral wall 62 is rotated with the rotation of the low-speed shaft 11 with oil sufficiently supplied to the ring contact areas Pa1, Pa 2, Pa3, an oil film (elastohydrodynamic lubrication film, or EHL film) is formed in the clearances between the projection 69 and the outer peripheral surfaces 71*a*, 72*a*, 73*a* of the respective rollers 71, 72, 73 at positions corresponding to the ring contact areas Pa1, Pa 2, Pa3. The projection 69 faces the outer peripheral surfaces 71*a*, 72*a*, 73*a* of the rollers 71, 72, 73 through the oil film. The rotational force of the peripheral wall 62 of the ring member 60 is transmitted to the rollers 71, 72, 73 through the oil film thereby to rotate the rollers 71, 72, 73 in the same rotational direction.

When the peripheral wall 62 is rotated with the rotation of the low-speed shaft 11 with oil sufficiently supplied to the shaft contact areas Pb1, Pb2, Pb3, an oil film (EHL film) is formed in the clearances between the outer peripheral surface 12*a* of the high-speed shaft 12 and the outer peripheral surfaces 71*a*, 72*a*, 73*a* of the rollers 71, 72, 73, respectively, at positions corresponding to the shaft contact areas Pb1, Pb2, Pb3. In other words, the outer peripheral surface 12*a* of the high-speed shaft 12 face the outer peripheral surfaces 71*a*, 72*a*, 73*a* of the rollers 71, 72, 73 through the oil film. The rotational power of the first, second and third rollers 71, 72, 73 is transmitted to the high-speed shaft 12 through the oil film thereby to rotates the high-speed shaft 12. In this case, the base 61 and the peripheral wall 62 are rotated at the same speed as the low-speed shaft 11 while the first, second and third rollers 71, 72, 73 are rotated at a speed greater than the low-speed shaft 11. The high-speed shaft 12 having a diameter smaller than the first, second and third rollers 71, 72, 73 is rotated at a speed in terms of rpm that is greater than that of the first, second and third rollers 71, 72, 73.

According to the speed increaser 14, rotation of the low-speed shaft 11 is transmitted to the high-speed shaft 12 and the high-speed shaft 12 rotates at a speed that is higher than that of the low-speed shaft 11.

In the centrifugal compressor 10 of the present embodiment, oil is circulated within the speed increaser housing 22. An inlet port 111 is formed in the upper part of the speed increaser housing 22 and an outlet port 112 is formed in the lower part of the speed increaser housing 22. Oil is introduced through the inlet port 111 and flowed to the contact areas Pa1, Pa2, Pa3, Pb1 Pb2, Pb3 in the speed increaser 14. Then, the oil is discharged through the outlet port 112. In other words, oil is to be supplied to the speed increaser 14.

The present invention offers the following effects. For the sake of the explanation, the effects will be described with reference to the relation between the first roller 71 and the peripheral wall 62 only, though the effects of the present invention can be seen in the second and third rollers 72, 73.

(1) The speed increaser 14 includes the annular peripheral wall 62 that is rotatable with the rotation of the low-speed shaft 11, the high-speed shaft 12 that is disposed radially inward of the peripheral wall 62, and the first roller 71 that is disposed between the peripheral wall 62 and the high-speed shaft 12.

The speed increaser 14 has the projection 69 extending radially inwardly from the inner peripheral surface 63 of the peripheral wall 62. The outer peripheral surface 71*a* of the first roller 71 is in contact with the projection 69 and the outer peripheral surface 12*a* of the high-speed shaft 12 when the first roller 71 is at a stop.

According to the speed increaser 14 having this configuration in which the projection 69 and the outer peripheral surface 71*a* of the first roller 71 are set in contact with each other, the first ring contact area Pa1 may be reduced, as compared with the case in which the peripheral wall has an inner diameter that is constant in the axial direction Z of the high-speed shaft 12. Accordingly, the pressure applied to the first ring contact area Pa1 may be increased. An oil film may be formed easily at the first ring contact area Pa1 when the first roller 71 is rotated with relatively small tightening force by the peripheral wall 62.

In addition, according to the present embodiment in which the high-speed shaft 12 and the first roller 71 are in contact with each other at their respective outer peripheral surfaces 12*a*, 71*a*, the first contact area Pb1 tends to become small and, accordingly a relatively high pressure is created at the contact areas Pa1, Pb1 The outer peripheral surface 71*a* of the first roller 71 and the outer peripheral surface 12*a* of the high-speed shaft 12 are curved in directions toward each other, or in the opposite directions, around the first shaft contact Pb1.

On the other hand, in the structure in which the first roller 71 and the peripheral wall 62 of the ring member 60 are in contact with each other at the outer peripheral surface 71*a* and the inner peripheral surface 63, the outer peripheral surface 71*a* of the first roller 71 and the inner peripheral surface 63 of the peripheral wall 62 are curved in the same direction at the first ring contact area Pa1. The first ring contact area Pa1 is greater than the first shaft contact area Pb1. Thus, the pressure at the first ring contact area Pa1 becomes smaller that at the first shaft contact area Pb1. Small pressure at the first ring contact area Pa1 may cause failure in formation of a solidified oil film with the rotation of the first roller 71, with the result that the power from the peripheral wall 62 may fail to be transmitted from to the first roller 71 effectively.

Although it may be contemplated to increase the tightening force of the peripheral wall 62 to solve the above-describe problem, such configuration increases the pressure acting at the first shaft contact area Pb1, which results in an increase of power loss at the first shaft contact area Pb1 and an application of excessive load to the high-speed shaft 12.

According to the present invention in which the provision of the projection 69 permits reducing the first ring contact area Pa1 without having an effect on the first shaft contact area Pb1, the pressure at the first ring contact area Pa1 may be increased without applying excessive load to the high-speed shaft 12. Thus, the rotation of the first roller 71 forms oil film at locations corresponding to the contact areas Pa1, Pb1, so that power of the peripheral wall 62 may be transmitted from the peripheral wall 62 to the high-speed shaft 12 effectively.

(2) The provision of the projection 69 having an annular shape extending in the circumferential direction of the peripheral wall 62 allows the pressure F1 to be applied to the first roller 71 constantly irrespective to the rotational position of the peripheral wall 62, so that stable application of pressure at the first ring contact area Pa1 may be maintained.

(3) The provision of the projection 69 having a semicircular shape in longitudinal section, or in cross section taken in a plane perpendicular to the circumferential direction of the peripheral wall 62 helps to reduce the first ring contact area Pa1, so that pressure at the first ring contact area Pa1 may be increased.

(4) The structure in which the peripheral wall 62 includes the body portion 67 and the distal end portion 66 having the wall thickness that is greater than the body portion 67 and the projection 69 is formed extending from the first inner surface 63*a* corresponding to the distal end portion 66 in the inner peripheral surface 63 of the peripheral wall 62. This permits reduction of the weight of the peripheral wall 62 while securing the pressures F1, F2.

(5) The provision of the projection 69 that is in contact with the axially intermediate part of the outer peripheral surface 71*a* of the first roller 71 in the axial direction Z of the high-speed shaft 12. This helps to prevent the unbalanced application of pressure to the first shaft contact area Pb1 such as the pressure being greater at one end than the other end of the first shaft contact area Pb1 in the axial direction Z In addition, load is distributed evenly to the first and second roller bearings 94, 95 that rotatably support the first roller 71. This prevents one of the roller bearings 94, 95 to be deteriorated prematurely.

(6) The centrifugal compressor 10 includes the electric motor 13 that rotates the low-speed shaft 11, the impeller 52 mounted on the high-speed shaft 12 and the speed increaser 14. This configuration of the centrifugal compressor 10 enables the impeller 52 to be rotated at a speed that is greater than the rotation speed of the electric motor 13. The centrifugal compressor 10 may be operated optimally through effective transmission of the rotation of the peripheral wall 62 to the high-speed shaft 12.

Figure 4:
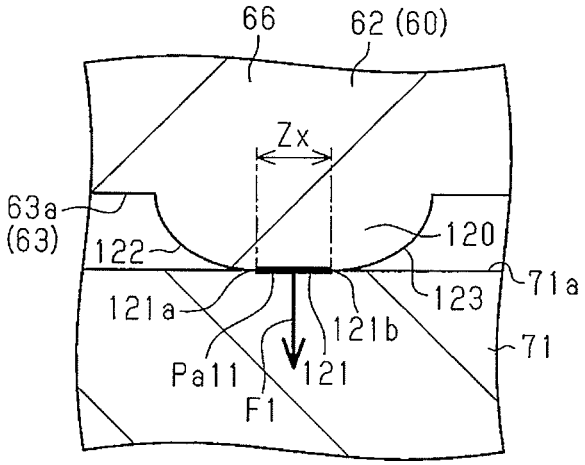
FIG. 4 is a fragmentary enlarged schematic cross-sectional view showing a first ring contact area according to a second embodiment.

The following will describe the speed increaser 14 according to a second embodiment of the present invention with reference to FIG. 4. The speed increaser 14 of the second embodiment differs from the first embodiment in the shape of the projection. For the sake of the description, FIG. 4 only shows contact of the first roller 71 with the peripheral wall 62 of the ring member 60. It is noted that the second and third rollers 72, 73 are in contact with the peripheral wall 62 substantially in the same manner. It is to be noted that a projection of the second embodiment, which is designated by numeral 120, is illustrated in enlarged size in FIG. 4.

As shown in FIG. 4, the projection 120 has an annular shape extending in the circumferential direction of the peripheral wall 62 and has an end surface 121 and a pair of first and second side surfaces 122, 123. It is noted that the circumferential direction of the peripheral wall 62 corresponds to the circumferential direction of the high-speed shaft 12.

The end surface 121 of the projection 120 is disposed radially inward of the inner peripheral surface 63 of the peripheral wall 62 (the first inner surface 63*a* according to the present embodiment). The end surface 121 extends in circumferential direction of the peripheral wall 62 and also in the axial direction Z of the high-speed shaft 12. The end surface 121 is in contact with the outer peripheral surface 71*a* of the first roller 71 at the first ring contact area Pa11.

The ring contact area Pa11 extends in the circumferential direction of the peripheral wall 62 and also in the axial direction Z of the high-speed shaft 12. Because the ring contact area Pa11 has a dimension extending in the axial direction Z of the high-speed shaft 12, the ring contact area Pa11 of the second embodiment is larger than the ring contact area Pa1 of the first embodiment.

It is noted that the axial direction of the high-speed shaft 12 corresponds to the width direction of the projection 120. The end surface 121 is a circumferential surface that extends circumferentially with respect to the axis of the peripheral wall 62, or the low-speed shaft 11, and has a width Zx extending in the axial direction Z of the high-speed shaft 12.

The end surface 121 of the projection 120 has flatness. For example, the end surface is so formed that the surface roughness is smaller than the thickness of the oil film formed at the ring contact area Pa11.

The width Zx of the end surface 121 is determined based on the pressure (load) F1 applied from the peripheral wall 62 to the first roller 71, a first Young's modulus E1 and a first Poisson's ratio v1 of the peripheral wall 62 and a second Young's modulus E2 and a second Poisson's ratio v2 of the first roller 71. Specifically, the width Zx of the end surface 121 is determined so as to correspond to the shape of the contact area that is obtained by the equation based on the Hertz's contact theory, assuming that the projection 120 has a semicircular shape having the radius r1 and the first roller 71 having the radius r2.

The first Young's modulus E1 and the first Poisson's ratio v1 are characteristic values determined by the material of the peripheral wall 62 and the second Young's modulus E2 and the second Poisson's ratio v2 are characteristic values determined by the material of the first roller 71. The pressure F1 is a parameter determined by the tightening of the peripheral wall 62. Therefore, it may be said that the width Zx of the end surface 121 of the second embodiment is determined by the tightening of the peripheral wall 62, the materials of the peripheral wall 62 and the first roller 71, and the radius r1 of the end surface 121 and the radius r2 of the first roller 71.

According to the present embodiment, the peripheral wall 62 and the first roller 71 are made of the same material, so that the first and second Young's moduli E1, E2 are the same values, and the first and second Poisson's ratios v1, v2 are the same values. The peripheral wall 62 and the first roller 71 need not necessarily be made of the same material.

As shown in FIG. 4, the pair of side surfaces 122, 123 are formed continuously with the opposite ends 121*a*, 121*b* of the end surface 121 in the width direction thereof, or in the axial direction Z of the high-speed shaft 12, and the inner peripheral surface 63 of the peripheral wall 62, respectively. Specifically, the first side surface 122 is formed continuous with the first end 121*a* of the end surface 121 and the inner peripheral surface 63 of the peripheral wall 62 and the second side surface 123 is formed continuous with the second end 121*b* of the end surface 121 and the inner peripheral surface 63 of the peripheral wall 62.

The side surfaces 122, 123 are curved so that the width of the projection 120, or the dimension of the projection 120 in the axial direction Z of the high-speed shaft 12, is reduced gradually towards the end surface 121. In other words, the projection 120 has a generally crown shape in longitudinal section of the speed increaser 14 having the end surface 121 disposed radially inward of the inner peripheral surface 63 of the peripheral wall 62 and the pair of the side surfaces 122, 123.

The paired side surfaces 122, 123 are convex with respect to the high-speed shaft 12. The paired side surfaces 122, 123 have a logarithmic curve shape in longitudinal section of the speed increaser 14, or when the projection 120 is taken in a plane perpendicular to the circumferential direction of the peripheral wall 62, so that lines which are tangential to the parts of the side surfaces 122, 123 adjacent to the end surface 121 extend generally in the same direction as the axial direction of the high-speed shaft 12. Thus, the opposite ends 121*a*, 121*b* of the end surfaces 121 and the side surfaces 122, 123 at the respective boundaries therebetween are smoothly joined without being pointed. In other words, the opposite ends 121*a*, 121*b* and the lines tangential to the part of the side surfaces 122, 123 disposed adjacent to the end surfaces 121 intersect at an angle greater than the 90 degree.

The above-described second embodiment of the present invention offers the effect below, as well as the effects (1), (2), (4) through (6) described with reference to the first embodiment. For the sake of the explanation, the effects will be described with reference to the relation between the first roller 71 and the peripheral wall 62 only, though the effects of the present invention can be seen in the second and third rollers 72, 73.

(7) The projection 120 which extends radially inwardly from the inner peripheral surface 63 of the peripheral wall 62 has the end surface 121 extending in the circumferential direction of the peripheral wall 62 and also in the axial direction Z of the high-speed shaft 12, and the end surface 121 of the projection 120 is set in contact with the outer peripheral surface 71*a* of the first roller 71. Because the end surface 121 extends in the axial direction Z of the high-speed shaft 12, the first ring contact area Pa11 is larger than the first ring contact area Pa1 of the first embodiment. This prevents the pressure at the first ring contact area Pa11 to become excessively large.

Pressure at the first ring contact area Pa11 increases with a reduction of the first ring contact area Pa11. Excessively large pressure at the first ring contact area Pa11 may cause a problem such as deformation of the peripheral wall 62 and the first roller 71 and seizure of the peripheral wall 62 and the first roller 71 by frictional heat.

According to the second embodiment in which the end surface 121 extending in the axial direction Z of the high-speed shaft 12 is set in contact with the outer peripheral surface 71*a* of the first roller 71, the first ring contact area Pa11 is larger than the first contact are Pa1 of the first embodiment. In other words, the projection 69 is in line contact with the outer peripheral surface 71*a* of the first roller 71, meanwhile the projection 120 of the second embodiment is in plane contact with the outer peripheral surface 71*a* of the first roller 71. This prevents pressure at the first contact area Pa11 to become excessively large.

In addition, because the first ring contact area Pa11 extends in the axial direction Z of the high-speed shaft 12, the peripheral wall 62 is unlikely to be inclined relative to the axial direction Z of the high-speed shaft 12, with the result that the peripheral wall 62 may be positioned stably, thereby preventing the vibration caused by the inclined peripheral wall 62.

(8) The provision of the generally flat end surface 121 permits machining the projection 120 without difficulty.

In the speed increaser 14 in which power is transmitted through the oil film (EHL) formed between the projection 120 of the peripheral wall 62 and the outer peripheral surface 71*a* of the first roller 71, surface roughness of the projection 120 and the outer peripheral surface 71*a* of the first roller 71 need to be small. The end surface 121 having a flat surface extending in the axial direction Z of the high-speed shaft 12 permit achieving suitable surface roughness more easily, as compared with the projection 69 of the first embodiment having an arc shape in longitudinal section. Thus, machining of the projection may be achieved easily.

(9) The projection 120 has the pair of side surfaces 122, 123 that are formed continuous with the opposite ends 121*a*, 121*b* of the end surface 121 and the inner peripheral surface 63 of the peripheral wall 62. The paired side surfaces 122, 123 are curved so that the width of the projection 120 is reduced from the inner peripheral surface 63 of the peripheral wall 62 to the end surface 121, and the side surfaces 122, 123 are convex with respect to the high-speed shaft 12.

The provision of the projection 120 having such shape permits smoothly connecting the opposite ends 121*a*, 121*b* of the end surface 121 with the first and second side surfaces 122, 123, respectively. In other words, the intersection of the line that is tangential to the side surface 122 and the end surface 121 at the boundary therebetween forms an obtuse angle, and the intersection of the line that is tangential to the side surface 123 and the end 121*b* of the end surface 121 at the boundary therebetween forms an obtuse angle. The provision of the projection 120 having such shape prevents concentration of pressure at the opposite ends 121*a*, 121*b* of the end surface 121, thereby allowing oil to be flowed to part of the ring contact area Pa11 corresponding to the center of the end surface 121 in the width direction thereof, which may be prevented by the concentration of pressure at the opposite ends 121*a*, 121*b* of the end surface 121.

(10) The provision of the projection 120 in which the pair of side surfaces 122, 123 are curved in a logarithmic curve shape in longitudinal section permits smoothly connecting the first and second ends 121*a*, 121*b* of the end surface 121 with the side surfaces 122, 123, respectively, thereby forming an obtuse angle at the intersection of the line tangential to the side surface 122 and end 121*a* of the end surface 121 at the boundary between the side surface 122 and the end 121*a* of the end surface 121 and also at the intersection of the line tangential to the side surface 123 and the end 121*b* of the end surface 121 at the boundary between the side surface 123 and the end 121*b* of the end surface 121. The provision of the projection 120 having a logarithmic curve shape prevents concentration of pressure at the opposite ends 121*a*, 121*b* of the end surface 121 more effectively.

(11) The width Zx of the end surface 121 is determined based on the pressure F1 applied from the peripheral wall to the first roller 71, the first Young's modulus E1 and the first Poisson's ratio v1 of the peripheral wall 62, the second Young's modulus E2 and the second Poisson's ratio v2 of the first roller 71, the radius r1 of the end surface 121, and the radius r2 of the first roller 71, with the result that an appropriate pressure is secured at the first contact area Pa11.

The embodiment of the present invention may be modified in various manners, as exemplified below.

Figure 5:
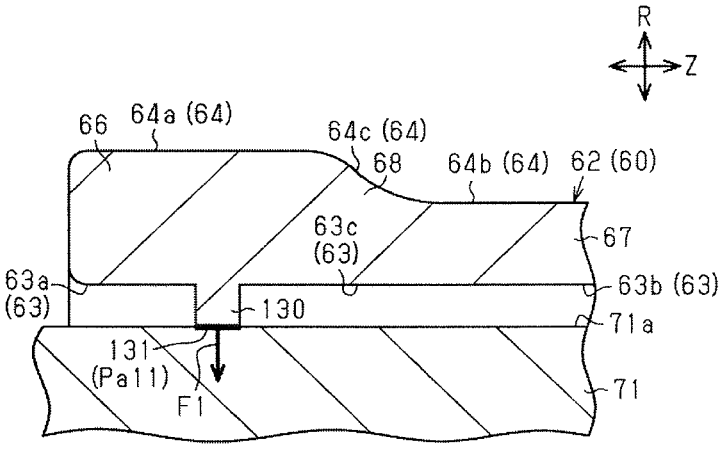
FIG. 5 is a fragmentary enlarged schematic cross-sectional view showing a projection of a speed increaser according to another example of the present invention.

The projection need not necessarily have a semicircular shape or a generally crown shape in longitudinal section as in the first and second embodiments, respectively. As shown in FIG. 5, for example, the projection, which is designated by numeral 130, may have a rectangular shape in cross section. In this case, the end surface 131 of the projection 130 shall be set in contact with the outer peripheral surfaces 71*a*, 72*a*, 73*a* of the first, second and hid rollers 71, 72, 73. The end surface 131 extends in the circumferential direction of the peripheral wall 62 and also in the axial direction Z of the high-speed shaft 12.

In view of reducing the contact area, however, the projection should preferably have a semicircular shape in cross section rather than a rectangular shape. In view of preventing concentration of the stress on the opposite ends of the end surface in the width direction thereof, the projection should preferably have a generally crown shape in cross section, as with the projection 120 of the second embodiment.

The projection 69 of the first embodiment need not necessarily have an annular shape extending in the circumferential direction of the peripheral wall 62, but may have a hemispherical shape. In this case, a plurality of discrete projections may be formed in the circumferential direction of the peripheral wall 62. This permits further reducing the contact area Pa1, Pa2, Pa3. Similarly, the projection 120 of the second embodiment need not necessarily have an annular shape extending in the circumferential direction of the peripheral wall 62, but may be formed by a plurality of discrete projection disposed along the circumferential direction of the peripheral wall.

The wall thickness of the peripheral wall 62 may be constant. In other words, the thick wall portion and the thin wall portion need not necessarily be formed.

The third outer surface 64*c* need not necessarily be formed by a sloped surface but may be formed by a surface extending perpendicular to the axial direction Z.

The projection such as 69 and 120 may be disposed at any suitable location. For example, the projection may be formed projecting from the third inner surface 63*c* or the second inner surface 63*b*. Additionally, the projection may be formed projecting from a position of the inner peripheral surface 63 of the peripheral wall 62 that is adjacent to the base end rather than to the front end thereof.

It may be so configured that the base 61 of the ring member 60 and the low-speed shaft 11 are formed integrally and the peripheral wall 62 is mounted to the base 61. Furthermore, the base 61, the peripheral wall 62 and the low-speed shaft 11 may be separately formed and assembled together.

Any suitable oil supply means may be used for the centrifugal compressor 10. For example, the centrifugal compressor 10 may be provided with an oil pump that supplies oil to the speed increaser housing 22.

The number of the rollers is not limited to three, but any suitable number of rollers may be used.

The speed increaser 14 may have a configuration in which at least one of the roller 71, 72, 73 is driven in accordance with the torque from the low-speed shaft 11.

The rollers 71, 72, 73 may have substantially the same diameter. In this case, the high-speed shaft 12 may be disposed coaxially with the ring member 60 or the low-speed shaft 11.

The width Zx of the end surface 121 need not necessarily be determined using the radius r2 of the first roller 71 as a parameter. In other words, the radius of the second roller 72 or the radius of the third roller 73 may be used as a parameter to determine the width Zx of the end surface 121. If the speed increaser 14 includes the first, second and third rollers 71, 72, 73 having different diameters, the smallest radius or the largest radius of the first, second and third rollers 71, 72, 73 may be used as a parameter to determine the width Zx.

The pair of side surfaces 122, 123 may be curved in an arc shape, instead of a logarithmic curve shape. The paired side surfaces 122, 123 may be concave with respect to the high-speed shaft 12 or tapered toward the end surface 121 of the projection 120.

The end surface 121 may have any suitable width Zx.

The compression part 15 need not necessarily be formed of an impeller type. For example, the vane type, or scroll type compression part may be used in the centrifugal compressor 10.

The use of the speed increaser 14 is not limited to the centrifugal compressor 10. For example, the speed increaser 14 may be mounted to a fluid machine such as a pump in which compression of fluid is not performed.

The speed increaser 14 and the centrifugal compressor 10 may be mounted to any equipment other than a vehicle.

The centrifugal compressor 10 may be used to compress any fluid. For example, the centrifugal compressor 10 may be used for an air conditioner so as to compress a refrigerant gas.

The centrifugal compressor may be made including any of the above features.

What is claimed is:

1. A speed increaser comprising:

a high-speed shaft;

an annular peripheral wall surrounding the high-speed shaft and rotatable with a rotation of a low-speed shaft, the peripheral wall having an inner peripheral surface and a projection extending inwardly from the inner peripheral surface in a radial direction of the high-speed shaft; and a roller disposed between the high-speed shaft and the peripheral wall and having an outer peripheral surface that is in contact with both the projection and an outer peripheral surface of the high-speed shaft, wherein the projection has an arc shape on opposite ends in an axial direction in a contact area where the projection is in contact with the roller when a cross-section of the projection is taken in a plane perpendicular to the circumferential direction of the peripheral wall, wherein the projection has an annular shape extending in a circumferential direction of the peripheral wall, and wherein the projection has a semicircular shape when the projection is taken in a plane perpendicular to the circumferential direction of the peripheral wall.

2. The speed increaser according to claim 1, wherein the peripheral wall has a thick wall portion and a thin wall portion, the thick wall portion has a wall thickness that is greater than the thin wall portion, and the projection is formed extending from the inner peripheral surface corresponding to the thick wall portion.

3. The speed increaser according to claim 2, wherein the thick wall portion faces an intermediate part of the outer peripheral surface of the roller with respect to an axial direction of the high-speed shaft, and the projection is in contact with the axially intermediate part of the outer peripheral surface of the roller.

4. The speed increaser according to claim 1, wherein the projection has an end surface extending in the circumferential direction of the peripheral wall and in the axial direction of the high-speed shaft, and the end surface is in contact with the outer peripheral surface of the roller.

5. The speed increaser according to claim 4, wherein the projection has a pair of side surfaces that are formed continuous with ends of the end surface in the axial direction of the high-speed shaft and the inner peripheral surface of the peripheral wall, the pair of side surfaces are curved so that a dimension of the projection in the axial direction of the high-speed shaft is reduced from the inner peripheral surface to the end surface of the peripheral wall, and the pair of side surfaces are convex with respect to the high-speed shaft.

6. The speed increaser according to claim 5, wherein the pair of side surfaces are curved in a logarithmic curve shape when the projection is taken in a plane perpendicular to the circumferential direction of the peripheral wall.

7. A centrifugal compressor comprising:

a low-speed shaft;

an electric motor driving to rotate the low-speed shaft;

a speed increaser including a high-speed shaft, and an annular peripheral wall surrounding the high-speed shaft and rotatable with a rotation of the low-speed shaft, the peripheral wall having an inner peripheral surface and a projection extending inwardly from the inner peripheral surface in a radial direction of the high-speed shaft, and a roller disposed between the high-speed shaft and the peripheral wall and having an outer peripheral surface that is in contact with both the projection and an outer peripheral surface of the high-speed shaft, wherein the projection has an arc shape on opposite ends in an axial direction in a contact area where the projection is in contact with the roller when a cross-section of the projection is taken in a plane perpendicular to the circumferential direction of the peripheral wall;

an impeller mounted to the high-speed shaft, the projection has an annular shape extending in a circumferential direction of the peripheral wall, and the projection has a semicircular shape when the projection is taken in a plane perpendicular to the circumferential direction of the peripheral wall.

* * * * *